US008893515B2

(12) United States Patent
Mak

(10) Patent No.: US 8,893,515 B2
(45) Date of Patent: Nov. 25, 2014

(54) METHODS AND CONFIGURATIONS OF BOIL-OFF GAS HANDLING IN LNG REGASIFICATION TERMINALS

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 1052 days.

(21) Appl. No.: 12/936,070

(22) PCT Filed: Apr. 7, 2009

(86) PCT No.: PCT/US2009/039740

§ 371 (c)(1), (2), (4) Date: Nov. 4, 2010

(87) PCT Pub. No.: WO2009/126604

PCT Pub. Date: Oct. 15, 2009

(65) Prior Publication Data

US 2011/0056238 A1 Mar. 10, 2011

Related U.S. Application Data

(60) Provisional application No. 61/044,302, filed on Apr. 11, 2008.

(51) Int. Cl.

| | |
|---|---|
| ***F17C 3/10*** | (2006.01) |
| ***F17C 9/02*** | (2006.01) |
| ***F17C 9/04*** | (2006.01) |
| ***F25J 1/00*** | (2006.01) |
| ***F25J 1/02*** | (2006.01) |

(52) U.S. Cl.

CPC ..... *F17C 9/04* (2013.01); *F17C 2265/05* (2013.01); *F17C 2260/046* (2013.01); *F17C 2227/0135* (2013.01); *F17C 2227/0393* (2013.01); *F17C 2227/0185* (2013.01); *F25J 1/0025* (2013.01); *F17C 2270/0136* (2013.01); *F17C 2227/0344* (2013.01); *F25J 1/0221* (2013.01); *F17C 2227/0348* (2013.01); *F17C 2265/015* (2013.01);*F17C 2265/07* (2013.01); *F17C 2223/0161* (2013.01); *F25J 1/0072* (2013.01);

(Continued)

(58) Field of Classification Search

USPC ..... 62/613, 614, 48.1, 48.2, 48.3, 50.1, 62/50.2, 50.3

See application file for complete search history.

(56) References Cited

U.S. PATENT DOCUMENTS 3,857,245 A * 12/1974 Jones ..... 60/651
3,894,856 A 7/1975 Lofredo et al.

(Continued)

FOREIGN PATENT DOCUMENTS

| | | |
|---|---|---|
| CA | 2580148 | 3/2006 |
| CA | 2645251 | 10/2007 |
| WO | 2005/047761 | 5/2005 |
| WO | 2005/071333 | 8/2005 |
| WO | 2006/066015 | 6/2006 |
| WO | 2009/011497 | 1/2009 |

*Primary Examiner* — Frantz Jules
*Assistant Examiner* — Keith Raymond
(74) *Attorney, Agent, or Firm* — Fish & Tsang, LLP

(57) ABSTRACT

A LNG storage and regasification plant includes a reliquefaction unit in which boil-off vapors from the storage tanks are re liquefied and recycled back to the LNG storage tanks for tank pressure and Wobbe index control. Preferably, LNG cold is used for reliquefaction and operational flexibility is achieved by feeding a portion of the pressurized boil-off gas to a fuel gas header and/or to be recondensed by the sendout LNG.

20 Claims, 2 Drawing Sheets

(52) U.S. Cl.
CPC ..... *F25J 1/004* (2013.01); *F17C 2223/033* (2013.01); *F17C 2227/0362* (2013.01); *F17C 2227/036* (2013.01); *F25J 1/0222* (2013.01); *F17C 2227/0157* (2013.01); *F17C 9/02* (2013.01); *F17C 2265/034* (2013.01); *F25J 1/0204* (2013.01); *F17C 2221/014* (2013.01); *F17C 2265/037* (2013.01); *F25J 1/0045* (2013.01); *F17C 2221/033* (2013.01); *F17C 2265/036* (2013.01); *F25J 2210/62* (2013.01); *F25J 1/005* (2013.01); *F25J 1/0288* (2013.01); *F25J 1/023* (2013.01); *F25J 1/0255* (2013.01)
USPC ..... 62/48.2; 62/50.2; 62/619

(56) References Cited

U.S. PATENT DOCUMENTS

| | | | | |
|---|---|---|---|---|
| 4,017,283 | A * | 4/1977 | Witt | 62/623 |
| 4,675,037 | A * | 6/1987 | Newton | 62/48.2 |
| 6,530,241 | B2 | 3/2003 | Pozivil | |
| 6,564,579 | B1 * | 5/2003 | McCartney | 62/620 |
| 7,201,002 | B1 | 4/2007 | Brown | |
| 7,493,778 | B2 * | 2/2009 | Engdahl | 62/614 |
| 8,028,724 | B2 * | 10/2011 | Lee et al. | 141/11 |
| 2006/0032239 | A1 * | 2/2006 | Sudduth et al. | 62/48.2 |
| 2008/0308175 | A1 | 12/2008 | Lee et al. | |

* cited by examiner

METHODS AND CONFIGURATIONS OF BOIL-OFF GAS HANDLING IN LNG REGASIFICATION TERMINALS

This application claims priority to our U.S. provisional patent application with Ser. No. 61/044302, filed Apr. 11, 2008, which is incorporated by reference herein.

FIELD OF THE INVENTION

The field of the invention is natural gas processing, especially as it relates to handling of boil-off gas and Wobbe index control in LNG regasification terminals.

BACKGROUND

U.S. pipeline gas is generally very lean, with heating values ranging from 1000 to 1070 Btu/scf, and more recently, FERC (the Federal Energy Regulatory Commission) has established guidelines and specifications for natural gas import. These guidelines require the Wobbe Index of the import gas to be within +/−4% with respect to the local gas quality, with a maximum value of 1400. California, which traditionally uses a very lean gas, requires a significantly lower Wobbe Index for the import gas. For example, the local air emission agency SCAQMD (Southern California Air Quality Management District) specifies a maximum Wobbe Index of 1360.

Unfortunately, the heating value of unprocessed import LNG is often significantly higher due to the relatively high ethane and propane content, which is not only incompatible with local rules and regulations, but also incompatible with many residential, commercial, and industrial burners. Examples for the wide variations in LNG composition, heating value, and Wobbe Index for LNG export terminals in the Atlantic, Pacific basins and the Middle East are shown in FIG. 1. As can be seen from FIG. 1, only Alaska's LNG can meet the gas quality specifications without nitrogen dilution for import to California while the remaining LNG requires nitrogen blending and/or NGL (natural gas liquids) extraction.

FIG. 2 illustrates the reduction in Wobbe Index before and after nitrogen dilution for the various LNG sources, up to a maximum 3 mol% $N_2$ limit. As can be taken from FIG. 2, less than half of the LNG sources meet the California Wobbe Index even with maximum nitrogen dilution. Moreover, due to the relatively tight margins on meeting the California Wobbe Index specification, changes in Wobbe Index due to weathering in the LNG storage may result in off specification product. The weathering effect of LNG from natural boil-off from the storage tanks enriches LNG in heavier components (i.e., C2+) over time, eventually rendering the weathered gas unacceptable as a pipeline gas with a higher Wobbe Index. While the weathering effect typically increases the Wobbe Index by a relatively small amount (e.g., about 3 to 6 points), such increase is problematic for marginal LNGs.

In various presently known LNG processing configurations to meet the Wobbe Index, non-methane components are removed from the LNG in a process that vaporizes the LNG in a demethanizer using a reboiler and re-condenses the demethanizer overhead to the sendout liquid that is then pumped and vaporized (see e.g., U.S. Pat. No. 6,564,579). While such configurations and methods typically operate satisfactorily for heating value or Wobbe Index control, they will require markets for the extracted NGL products, which are not always available. Moreover, in most cases where LNG terminals are configured for BTU delivery to commercial and residential users, there are no economic incentives for NGL extraction.

Alternatively, anti-weathering configurations can be implemented to reduce increase of Wobbe index as described in U.S. Pat. No. 7,201,002. Here the boil-off vapor is condensed within the confines of the tank using LNG refrigeration and pressure regulation. Similarly, as shown in U.S. Pat. No. 6,530,241, boil-off vapors can be reliquefied on board to control Wobbe index and product loss. However, such configurations are typically limited to either on-board systems that are inflexible with respect to changing and relatively large vapor loads, and/or will require cryogenic equipment and relatively large capital cost. Other systems and methods with similar difficulties are described in U.S. Pat. Nos. 3,894,856 and 4,675,037, U.S. Pat. App. No. 2008/0308175, and WO 2005/047761.

Therefore, while various LNG heating value control methods are known in the art, all or almost all of them suffer from one or more disadvantages, especially where import LNG is used, where NGL markets do not exist, and where the Wobbe Index of the import LNG only marginally meets local specifications. Thus, there is still a need for improved configurations and methods for maintaining the Wobbe Index while providing operating flexibility for the LNG regasification terminals with lower energy consumption.

SUMMARY OF THE INVENTION

The present inventive subject matter is directed to methods and plants of maintaining Wobbe index of LNG in a storage and regasification facility. Contemplated methods and plants allow for operational flexibility and stable storage tank pressure control while maintaining the Wobbe index throughout various storage, loading, and unloading conditions.

Most preferably, the boil-off gas is compressed in a compression unit and a large fraction of the compressed boil-off gas is further processed while another fraction is routed (typically after further compression) to the fuel header of a combustor or other destination suitable for relatively lean gas. Depending on operational status of the tank, processing of the compressed boil-off gas may be predominantly (or even exclusively) recondensation in a traditional LNG condenser using sendout LNG or primarily reliquefaction and separation of nitrogen wherein the reliquefied lean LNG is fed back to the tank (directly or via intermediate storage) while the nitrogen is recycled back to combine with the boil-off gas.

In one especially preferred aspect of the inventive subject matter, a method of Wobbe index control of LNG in an LNG storage tank includes a step of fluidly coupling an LNG storage tank to a regasification unit such that the tank provides LNG to the regasification unit. A compression unit is further fluidly coupled to the LNG storage tank such that the tank provides cold boil-off gas to the compression unit, wherein the compression unit forms a compressed boil-off gas. In another step, a first stream of the compressed boil-off gas is heat-exchanged using the cold boil-off gas to form cooled compressed boil-off gas, and in yet another step, a first portion of the cooled compressed boil-off gas is combined with the LNG. In a still further step, a second portion of the cooled compressed boil-off gas is partially reliquefied, and nitrogen is separated from the reliquefied boil-off gas to produce a lean reliquefied boil-off gas. The lean reliquefied boil-off gas is then fed into the LNG storage tank.

Therefore, and viewed from a different perspective, a LNG storage and regasification plant will include a LNG storage tank that is fluidly coupled to a regasification unit to provide LNG from the tank to the regasification unit. A compression unit is also coupled to the LNG storage tank to provide cold boil-off gas from the tank to the compression unit, wherein the compression unit is configured to form a compressed boil-off gas. A heat-exchanger cools a first stream of the compressed boil-off gas using the cold boil-off gas to so form a cooled compressed boil-off gas, and a first conduit is provided to combine a first portion of the cooled compressed boil-off gas with the LNG. Contemplated plants further include a cooler that reliquefies a second portion of the cooled compressed boil-off gas to form a partially reliquefied boil-off gas, and a separator separates nitrogen from the reliquefied boil-off gas to so produce a lean reliquefied boil-off gas. A second conduit configured is provided to feed the lean reliquefied boil-off gas into the LNG storage tank.

It is generally preferred that the cooled compressed boil-off gas and the LNG are combined and fed into a recondenser that is typically upstream of the regasification unit. It is also generally preferred that the LNG provides at least some of the refrigeration duty for the reliquefaction, which is most preferably performed in cold box. In further contemplated aspects of the inventive subject matter, nitrogen is separated from the reliquefied boil-off gas by expansion of the reliquefied boil-off gas in a JT valve or an expander and by separating the so expanded reliquefied boil-off gas in a separator. Most typically, the nitrogen is then combined with the cold boil-off gas.

Additionally, it is generally preferred that a second stream of the compressed boil-off gas is compressed and supplies fuel gas to the facility in a combustor or other process that employs lean gas. In particularly preferred aspects, the plant operation is controlled such that the ratio between the first and second portions is increased when the flow of the LNG to the regasification unit increases. Viewed from another perspective, contemplated configurations provide operational flexibility for the LNG regasification facility allowing reliquefying boiloff gas ranging from 1 MMscfd to 50 MMscfd at LNG sendout rates ranging from 100 MMscfd to 2000 MMscfd. Such configuration can control the Wobbe Index of LNG sendout while requiring minimum energy consumption in the boiloff gas reliquefaction process.

Various objects, features, aspects and advantages of the present invention will become more apparent from the following detailed description of preferred embodiments of the invention.

DETAILED DESCRIPTION

The inventor has discovered that changes in Wobbe Index due to weathering in the LNG storage tank can be reduced, and typically entirely prevented where at least part of the boil-off vapors are reliquefied during storage and where at least part of the vapors are condensed in sendout LNG. Further flexibility is provided by routing at least another portion of the vapors to a fuel header or other device that uses lean natural gas.

For example, in one especially preferred method, Wobbe index control of LNG in an LNG storage tank coupled to a regasification unit may be achieved by use of a compression unit that compresses cold boil-off gas from the tank, and by heat exchanging a first stream of the compressed boil-off gas using the cold boil-off gas or LNG to form cooled compressed boil-off gas. One portion of the cooled compressed boil-off gas is then combined with the LNG, while another portion of the cooled compressed boil-off gas is reliquefied. Nitrogen is then separated from the reliquefied boil-off gas to produce a lean (i.e., C2+ content of less than 3 mol%, and more typically less than 2 mol%) reliquefied boil-off gas that is then fed into the LNG storage tank.

Thus, LNG storage and regasification plants suitable for use herein will typically include a LNG storage tank that provides LNG to a regasification unit and that provides boil-off gas to a compression unit. At least a portion of the compressed boil-off gas is then cooled in a heat exchanger (typically using refrigeration content of the boil-off vapor and/or the LNG), and the so formed cooled compressed boil-off gas is then split into two streams, one that is combined with the LNG (typically via a condenser), and one that is further cooled in a cooler to reliquefaction. Where desired, a separator can be implemented to allow separation of nitrogen or other non-condensable components from the reliquefied boil-off gas to so produce a lean reliquefied boil-off gas. The lean reliquefied boil-off gas is then directly (or indirectly via a storage tank) fed into the LNG storage tank for Wobbe index control.

Figure 1:
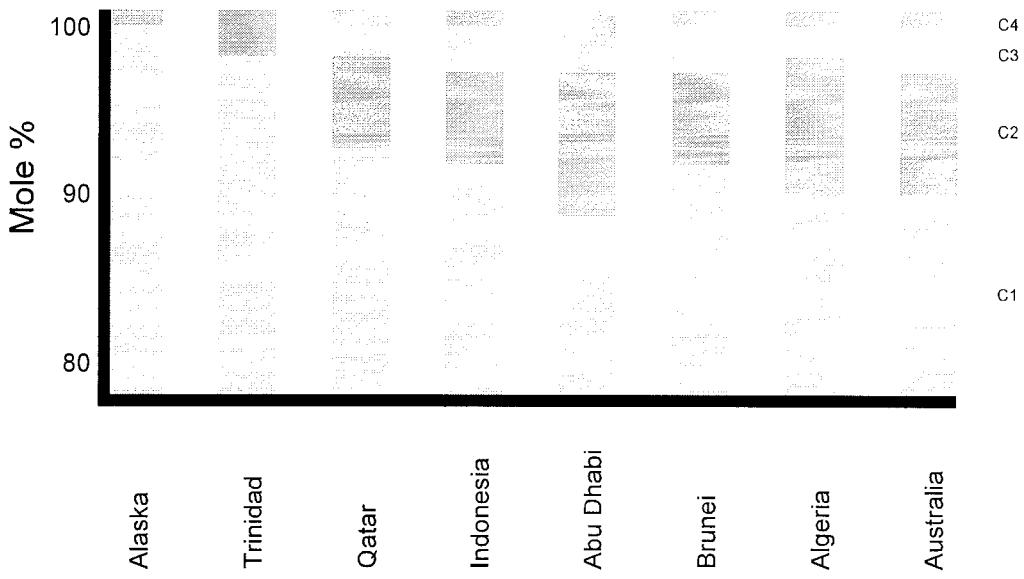
FIG. 1 is an exemplary illustration for variations in the LNG composition for LNG originating from various geographic sources.
Figure 2:
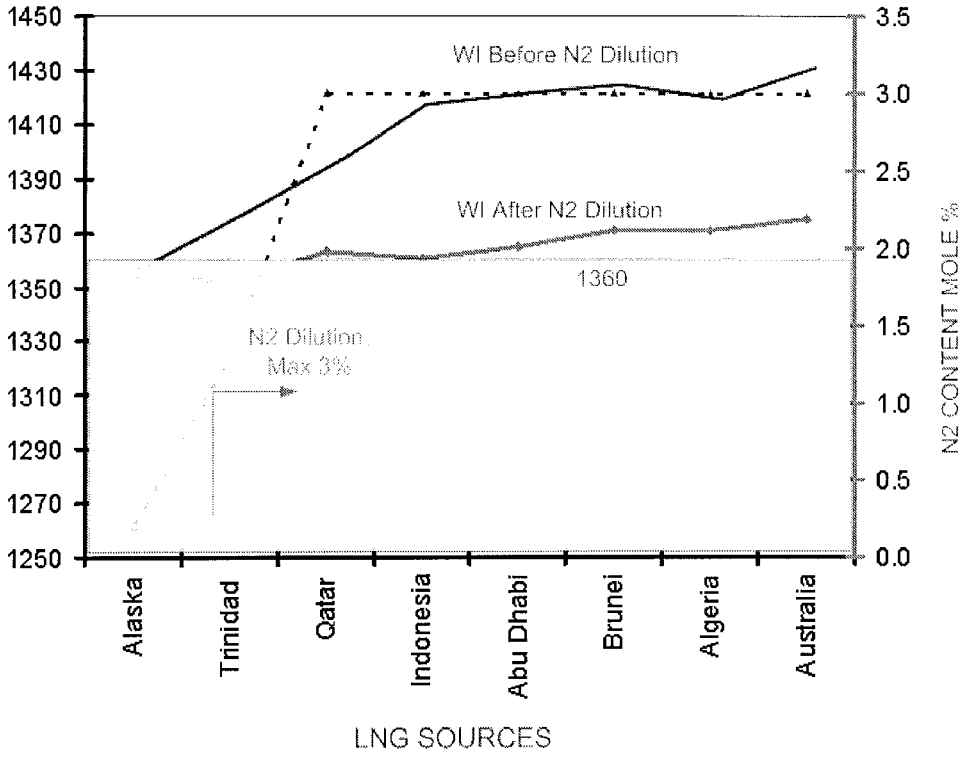
FIG. 2 is an exemplary illustration for the reduction in Wobbe Index before and after nitrogen dilution for the various LNG sources of FIG. 1.
Figure 3:
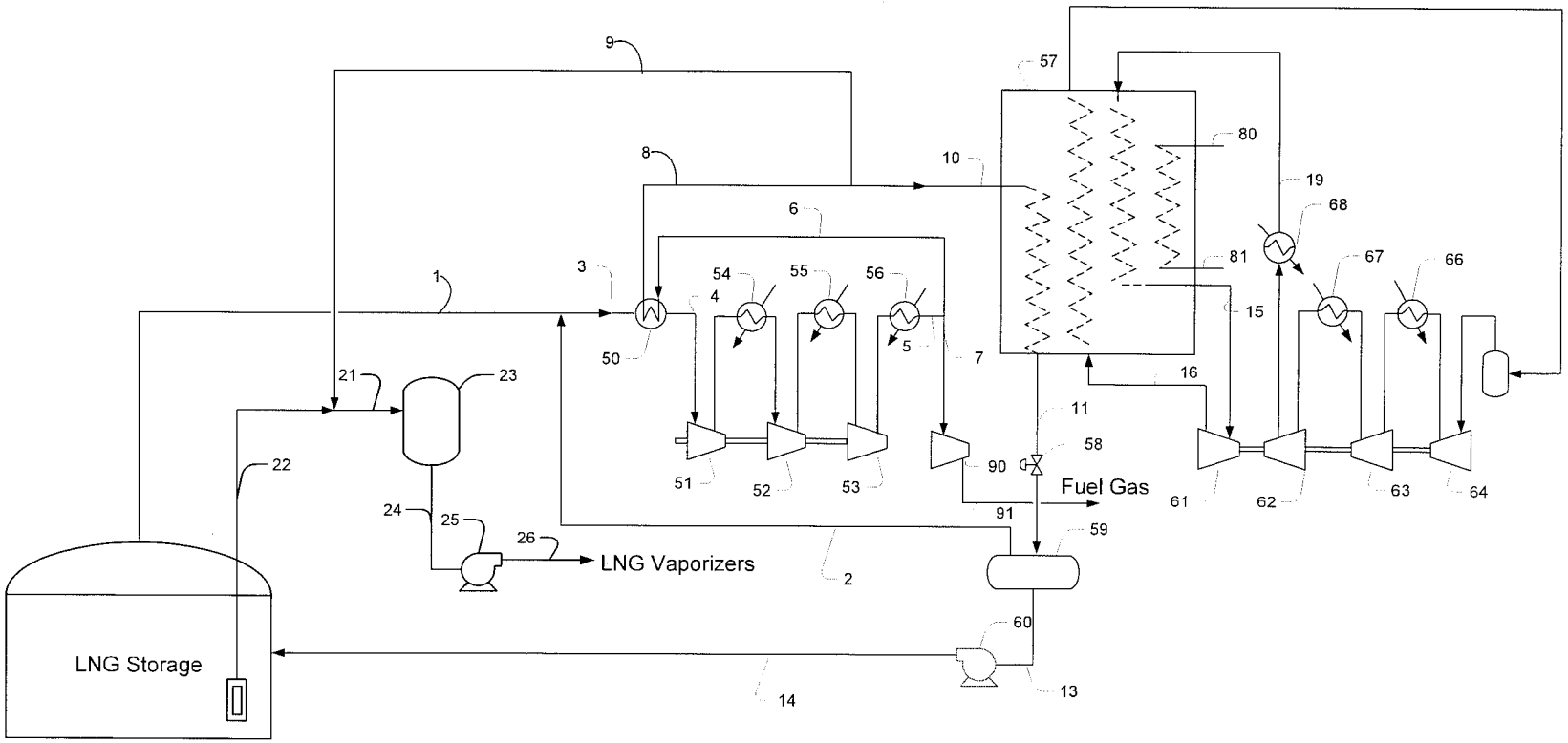
FIG. 3 is an exemplary scheme for a plant configuration according to the inventive subject matter.

FIG. 3 is one exemplary configuration of a LNG storage and regasification plant in which a boil-off gas reliquefaction unit is integrated into an LNG receiving terminal (feed line to the tank not shown). Here, the boil-off gas from the storage tank stream 1, typically at a flow rate of 8 to 16 MMscfd, at a temperature of −160° C., is heated in exchanger 50 to stream 4 using the compressed boil-off gas stream 6, to about −20° C. to 10° C., and then compressed by four stage BOG compressor 51, 52, and 53, and 90 from atmospheric pressure to about 8.5 barg or higher. The discharge pressure is preferably between 8 barg and 25 barg or as needed to meet the fuel gas pressure requirement of the gas turbine power generator (not shown). Compressor discharges are cooled in exchangers 54, 55, and 56 to form stream 5 using ambient air or cooling water. However, it is especially preferred that the refrigeration content from LNG is utilized for cooling since a lower temperature can be achieved, which can significantly reduce power consumption of the boil-off gas compressor while at the same time heating requirement for LNG regasification is reduced.

The pressurized boil-off gas stream 5 from exchanger 56 is split into at least two streams, 6 and 7. Stream 7 is further compressed to 15 to 25 barg by the fourth BOG compression stage 90 forming stream 91 that is sent to fuel gas system supplying fuel gas to a gas turbine power generator or other combustion header. Stream 6 is cooled in exchanger 50 forming stream 8, typically at −140° C., which is then further split into streams 9 and 10. During peak sendout operation when power supply is limited, stream 9 is mixed with the sendout LNG stream 22 from the storage tank, forming a condensed stream 21. Condensation occurs in conventional boil-off gas recondenser 23, forming a subcooled stream 24 which is pumped by pump 25 to so form the high pressure sendout stream 26 that is fed to the LNG vaporizers (not shown).

The compressed boil-off gas stream 10 is further cooled and liquefied in the cold box 57 forming stream 11, typically at −170° C. Cooling is supplied by refrigeration produced using a three stage nitrogen compressor 62, 63, and 64. Compressor discharges are cooled in exchangers 66, 67, and 68 using ambient air or cooling water. Nitrogen is compressed from a suction pressure of 8 to 11 barg to a final discharge pressure of about 36 to 50 barg, cooled in the cold box 57, and then expanded in turbo expander 61 to stream 16. Preferably, the refrigeration content from stored or sendout LNG is utilized for cooling, which can significantly reduce the power consumption of the nitrogen compressor while also reducing the heat for LNG regasification. Optionally, the refrigeration content from LNG (via a heat transfer fluid) can also be utilized for cooling in the box cold using LNG stream 80 (to stream 81), which further significantly reduces the power consumption of the nitrogen compressor.

In addition to the refrigeration available from LNG, the turbo expander 61 produces cryogenic refrigeration in stream 16 at about −180° C. for boil-off gas liquefaction and for cooling the compressed nitrogen stream 19 from ambient temperature to form stream 15 at about −145° C. The expander also generates power which reduces the power consumption by the nitrogen compressor. The operating pressure of nitrogen compressor is dependent on the boil-off gas compressor discharge pressure. A higher boil-off gas compressor discharge pressure will reduce the refrigeration duty requirement. The total power consumption of the boil-off gas reliquefaction unit is about 5 to 6 MW when cooling is by cooling water. When the LNG cold is utilized in cooling, the overall power consumption can be reduced, typically by as much as 50%.

The condensate stream 11 from the cold box typically, at −160° F., is let down in pressure in JT valve 58 to flash drum 59 forming a flash liquid stream 13 typically at −170° C., which is pumped by pump 60 forming stream 14 to the storage tank. For further energy savings, the condensate can be pressured using the potential energy in stream 11 or free drained to the storage tank, thus eliminating the use of pump 60. The flash gas stream 2, which mostly comprises the non-condensable nitrogen, is recycled back to the boil-off gas compressor suction to form stream 3.

Therefore, it should be appreciated that operational flexibility to accommodate variable volumes of boil-off vapors is achieved by providing conduits via which cooled and compressed boil-off vapor can be fed to a fuel gas header for combustion (or other sink), sendout LNG for condensation and adsorption, and/or a liquefaction unit in which the cooled and compressed boil-off vapor is reliquefied and fed back to the storage tank to reduce or maintain Wobbe index. Thus, it should be appreciated that contemplated LNG storage configurations and methods will reduce or even eliminate adverse effects of weathering and so provide Wobbe index control without the need for additional plant components.

In especially preferred configurations and methods, low pressure cryogenic boil-off gas from a LNG storage unit is first heated by compressed boil-off gas to about ambient temperature, and compressed to 8 barg or higher pressure. A portion of the compressed boil-off gas is then cooled and used as fuel gas to gas turbines, while another portion is cooled by the low pressure cryogenic boil-off gas to a lower temperature prior to feeding into a cold box for reliquefaction and/or prior to recondensation by mixing with the sendout LNG. The fuel gas to the gas turbine may be further compressed as appropriate to meet gas turbine fuel pressure requirement. Most typically, a flashed condensate is produced from the reliquefied boil-off gas and is pressurized and returned to the storage tank for Wobbe Index control. It should be especially appreciated that the feed exchange produces a cryogenic high pressure gas to the cold box, which significantly reduces the refrigeration duty in the cold box of the known design, resulting in power savings of at least 30 to 40%. It should also be appreciated that with close to ambient temperature operation, carbon steel material can be used for the construction of the boil-off gas compressor which significantly saves equipment cost.

It is further preferred that the condensate from the boil-off gas reliquefaction can be either returned to the LNG storage or to a separate storage tank that is reserved for holding lean reliquefied LNG for dilution of rich LNG in a later part of the LNG regasification cycle (due to weathering), thereby maintaining the Wobbe Index throughout the regasification process. Consequently, it should be recognized that contemplated configurations and methods eliminate the uncertainty of Wobbe Index changes due to weathering in LNG storage tanks which are typically designed for 0.05 to 0.2 volume % boil-off per day. This is particularly critical in environmental sensitive markets where a stringent Wobbe Index must be met (e.g., California market). Viewed from a different perspective, contemplated configurations and methods provide operational flexibility by liquefying the boil-off gas at an optimum pressure while allowing a portion of the pressurized boil-off gas to be used as fuel gas to gas turbine power generator and/or routed to the boil-off gas recondenser which minimizes the reliquefaction power consumption during peak sendout operation.

Further known aspects, configurations, and methods suitable for use herein are described in our co-pending International patent application having publication number WO 2006/066015. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, specific embodiments and applications of LNG regasification plants with Wobbe index control have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of Wobbe index control of LNG in an LNG storage tank, comprising:

fluidly coupling an LNG storage tank to a regasification unit such that the tank provides LNG to the regasification unit;

fluidly coupling a compression unit to the LNG storage tank such that the tank provides cold boil-off gas to the compression unit, wherein the compression unit forms a compressed boil-off gas;

heat-exchanging a first stream of the compressed boil-off gas using the cold boil-off gas to form cooled compressed boil-off gas, and combining a first portion of the cooled compressed boil-off gas with the LNG that is fed to the regasification unit;

reliquefying a second portion of the cooled compressed boil-off gas to form a reliquefied boil-off gas;

separating nitrogen from the reliquefied boil-off gas to produce a lean reliquefied boil-off gas; and feeding the lean reliquefied boil-off gas into the LNG storage tank.

2. The method of claim 1 further comprising a step of feeding the combined cooled compressed boil-off gas and LNG into a recondenser upstream of the regasification unit.

3. The method of claim 1 wherein LNG provides refrigeration content for the step of reliquefying.

4. The method of claim 3 wherein the step of reliquefying comprises use of a cold box.

5. The method of claim 1 wherein the step of reliquefying comprises use of a cold box.

6. The method of claim 1 wherein the step of separating nitrogen from the reliquefied boil-off gas comprises a step of expanding the reliquefied boil-off gas in a JT valve or an expander and separating the expanded reliquefied boil-off gas in a phase separator.

7. The method of claim 4 wherein the nitrogen is combined with the cold boil-off gas.

8. The method of claim 1 further comprising a step of compressing a second stream of the compressed boil-off gas.

9. The method of claim 8 wherein the second stream of the compressed boil-off gas is fed to a combustor or utilized as fuel gas.

10. The method of claim 1 further comprising a step of increasing a ratio between first and second portion when flow of the LNG to the regasification unit increases.

11. A LNG storage and regasification plant comprising:

a LNG storage tank fluidly coupled to a regasification unit to allow providing LNG from the tank to the regasification unit;

a compression unit fluidly coupled to the LNG storage tank to allow providing cold boil-off gas from the tank to the compression unit, wherein the compression unit is configured to form a compressed boil-off gas;

a heat exchanger configured to allow cooling of a first stream of the compressed boil-off gas using the cold boil-off gas to so form a cooled compressed boil-off gas;

a first conduit configured to allow combination of a first portion of the cooled compressed boil-off gas with the LNG that is provided to the regasification unit;

a cooler configured to allow reliquefaction of a second portion of the cooled compressed boil-off gas to form a reliquefied boil-off gas;

a separator configured to allow separation of nitrogen from the reliquefied boil-off gas to so produce a lean reliquefied boil-off gas; and a second conduit configured to allow feeding the lean reliquefied boil-off gas into the LNG storage tank.

12. The storage and regasification plant of claim 11 further comprising a recondenser upstream of the regasification unit hath is configured to receive the cooled compressed boil-off gas and the LNG.

13. The storage and regasification plant of claim 11 wherein the cooler is configured to employ refrigeration content from the LNG for the reliquefaction.

14. The storage and regasification plant of claim 13 wherein the cooler is a cold box.

15. The storage and regasification plant of claim 11 wherein the cooler is a cold box.

16. The storage and regasification plant of claim 11 further comprising an expansion device upstream of the separator and configured to at least partially expand the reliquefied boil-off gas.

17. The storage and regasification plant of claim 14 further comprising a third conduit that is configured to allow combination of the nitrogen with the cold boil-off gas.

18. The storage and regasification plant of claim 11 further comprising a compressor that is configured to allow compression of a second stream of the compressed boil-off gas.

19. The storage and regasification plant of claim 18 wherein the compressor is fluidly coupled to a combustor to allow feeding of the second stream from the compressor to the combustor.

20. The storage and regasification plant of claim 11 further comprising a flow control unit that is configured to allow increasing a ratio between the first and second portion when flow of the LNG to the regasification unit increases.

* * * * *